United States Patent [19]

Schröder

[11] 4,107,808

[45] Aug. 22, 1978

[54] DEVICE FOR PREPARING THE CLEANING OF CARPET FLOORS

[76] Inventor: Herbert Schröder, 65b Kadettenweg, 1000 Berlin (West) 45, Germany

[21] Appl. No.: 644,458

[22] Filed: Dec. 29, 1975

[51] Int. Cl.[2] ..... A47L 11/32

[52] U.S. Cl. ..... 15/41 R; 15/4; 15/47; 15/142; 15/186; 15/383; 15/393

[58] Field of Search ..... 15/27, 4, 41–48, 15/142, 186, 187, 197, 393, 398, 400, 383, 384, 200, 198

[56] References Cited

U.S. PATENT DOCUMENTS

| | | | |
|---|---|---|---|
| 214,593 | 4/1879 | Sibley | 15/27 X |
| 753,970 | 3/1904 | Foster | 15/186 X |
| 3,120,851 | 2/1964 | Pollak et al. | 15/400 X |
| 3,745,605 | 7/1973 | Gitschel et al. | 15/400 |

FOREIGN PATENT DOCUMENTS

| | | | |
|---|---|---|---|
| 267,673 | 3/1927 | United Kingdom | 15/27 |

*Primary Examiner*—Edward L. Roberts
*Attorney, Agent, or Firm*—Michael J. Striker

[57] ABSTRACT

An apparatus for loosening-up the walked-down nap of a carpet has a carrier that rides on rollers on the carpet and which is provided with a pair of brushes spaced apart in the displacement direction. Each brush has an elastic bed for a multiplicity of wire bristles with bent-over ends that engage in and loosen up the carpet nap. The brushes may be cylindrical and driven by a motor on the carrier which also drives the rollers. The trailing brush engages more deeply in the carpet nap than the leading brush.

7 Claims, 4 Drawing Figures

DEVICE FOR PREPARING THE CLEANING OF CARPET FLOORS

BACKGROUND OF THE INVENTION

The invention relates to an apparatus for preparing carpets with flattened nap for cleaning and having a brushing and scratching tool provided with a carrier that is moved over the carpet and from which downwardly extend bar-like elements which engage in the carpet nap and serve to loosen it.

Such an apparatus by means of which the nap of a carpet is supposed to be arranged for subsequent cleaning is already known. A brush-like tool with rod-like members is drawn through the carpet nap. This tool is however not intended for use with carpets of different nap lengths. Only longknapped carpets, such as used in residences, and which are not subject to considerable traffic, can be loosened up enough with such a tool that the particles of dirt deposited in the nap can be sucked out. This known device does not permit the cleaning of short-nap carpets with a fine dense nap as are for instance used in sales areas of stores or banks where they are subject to rather considerable dirt and wear along with considerable pedestrian traffic. The relatively widely spaced and thick rod-like elements of the brush tool, which are made of the same material as the plate carrying these elements and which are integral therewith, can in fact not effectively engage in the walked-down fine and dense nap of a low-nap carpet. On one hand the spacing between the rod-like members is too large to insure a complete engagement against all of the nap and on the other hand these rod-like elements, which must have a relatively great elasticity so as to work on the long nap without damaging it, are deflected in every direction when used on walked-down short-nap carpets and do not therefore loosen the dirt therein.

On the application date other brushes were known which had a separate elastically bedded wire bristles. These are hair or wig brushes which are meant to work on human hair and whose wire bristles therefore must be very loosely bedded so that the hair being worked on, which is not being loosened up because of dirt, is not ripped out. Such brushes are in an entirely different field.

Further known arrangements, serving to raise nap before cleaning of carpets and having motor-driven rotating rollers whose peripheries are provided with alternate rigid short and long bars, are only usable for raising a nap with a length of approximately 40 mm. Carpets with such a high nap are exclusively found in private rooms and normally are not dirtied so much that the nap is stuck to the backing. These already known devices with widely spaced rigid rods are not suitable for raising the walked-down and stuck-together nap of carpets which are provided in rooms subjected to heavy pedestrian traffic; since an apparatus with a motor-driven roller provided with rigid radially extending rods which serves to comb out the long nap of carpets would when this roller is used for the raising of a low stuck-together nap subject this short nap with a correspondingly great force which would in most cases wear it away since each individual stiff member would transmit the full rotational force of this roller to the nap in a case when this nap as a result of being very dirty offered a correspondingly high resistance to the apparatus.

SUMMARY OF THE INVENTION

It is an object of the present invention to improve on the apparatus described above so that even relatively short-nap carpets with walked-down fine and dense nap can be given a cleaning effective right down to the backing because the dirt sticking together the nap is loosened from the bottom up.

In accordance with this invention an apparatus of the above-described general type is provided with a brushing or scratching tool constituted as a brush with individual separate wire bristles and an elastic base for these bristles.

The apparatus according to the present invention engages with its brushing and scratching tool carefully however deeply in the walked-down stuck-together nap of a carpet. Each of the separate wire bristles can therefore exert only on the pile lying in front of it a certain exactly defined force which corresponds to the holding force of its elastic bedding. Since a multiplicity of such bristles, which may be arrayed in one or more successive brushes, act successively on the floor, in spite of the limited working surface of a single brush, the loops, pile, or fiber forming the nap is raised so that simultaneously the dirt held in the nap, even that dirt which has worked its way all the way down to the carpet backing, is scratched out by the tips of the bristles. Damaging of the nap is completely ruled out due to the exact limiting of the force exertable by the wire bristles.

A particularly advantageous embodiment of the bristles in the scope of the invention is that the lower ends of the wire bristles are bent over into a hook shape in the displacement direction.

Thereby the angle of attack of each individual bristle, which sticks generally perpendicularly out of the bristle bed, is considerably increased. In addition the spacing and length of the individual wire bristles may be changed according to type of carpet, type of nap, and nap strength, so that it is possible always to obtain an optimal loosening-up of the nap. Since the wire bristles of the individual bristle rows are offset relative to one another, so as to be staggered, the nap of the carpet being treated is continuously engaged.

In addition the effectiveness of the apparatus according to the present invention may be increased by giving the bristles provided on the underside of the frame different heights in the transport direction so that the leading brushes do not engage as deeply in the carpet as the trailing brushes. The carpet nap is therefore somewhat loosened up by the first brushes that engage it and the thus preloosened nap is then completely raised by the following brushes which engage more deeply in the nap. Correspondingly it is also of course possible to provide three or more brushes or brush rows one behind the other at stepped heights in order to effect a raising of the nap in smaller individual steps such that as described above the engaging force of each individual bristle can remain limited.

The functioning of the apparatus according to the invention can also be intensified through another inventive feature in that the brush itself is as is known set up for carrying different weights for loading down the brushes. The overall weight necessary for a sufficiently deep engagement of the individual bristles into the carpet is in this case in a statistically known manner evenly spread out over all of the bristles.

As a result of the intensive engagement of the apparatus according to the present invention in the carpet nap driving forces can be necessary as the effort exertable by the average strong operator who should be able to use the apparatus economically over long periods of time is often exceeded. In order to obtain an economic use of the apparatus according to the invention the apparatus is therefore provided with an electric-motor drive which is effective on corresponding rollers of the apparatus.

The apparatus according to the invention that is intended to preclean carpets and rugs, as a result of the intensive scratching-out of dirt, causes a substantial amount of dry scratched-out dust to be raised so that the deposition of this dust on nearby surfaces is a strong possibility. In order to overcome this the apparatus according to the invention is provided in the region of the brushes, preferably therebehind, with a closable opening connectable to a vacuum cleaner. The dirt scratched by the bristles out of the carpet is thereby taken up through the sucking opening provided relative to the transport direction behind these brushes so that this dust does not come to rest on neighboring surfaces.

Instead of relatively planar brushes in accordance with the present invention it is also possible to provide a cylindrical brush which is driven at a relatively low rotational rate by an electric motor through a transmission, in such a situation the device rests on rollers and the wire bristles in their lowermost position extend downwardly beyond the plane defined by the rollers through the predetermined engagement depth.

The apparatus according to the invention is more fully described in the following with reference to the embodiment shown in the drawing.

BRIEF DESCRIPTION OF THE DRAWINGS

There is shown in.

DESCRIPTION OF PREFERRED EMBODIMENTS

Figure 1:
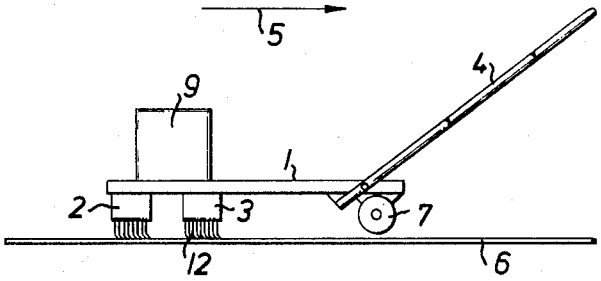
FIG. 1 a side view of an apparatus according to the invention.

Thus the apparatus comprises a frame 1 on whose underside are secured brushes 2 and 3. In addition there is secured to the frame 1 a pivotal bow-type handle 4. The apparatus is guided over the carpet 6 in the direction of arrow 5. At the leading portion of the frame 1 there are provided on the underside rollers 7 by means of which the apparatus, after being pushed down on its right-hand side so that the two brushes 2 and 3 are lifted from the carpet 6, can be easily moved to another location.

Figure 2:
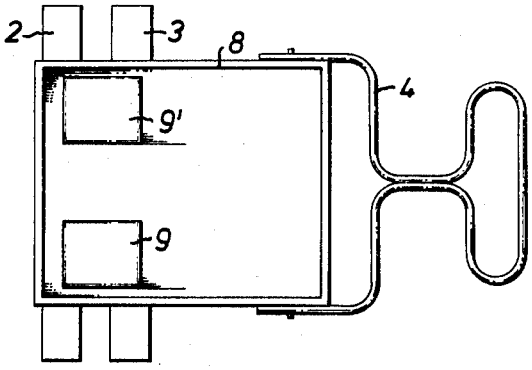
FIG. 2 a top view of the apparatus according to FIG. 2.

According to FIG. 2 the frame 1 is formed substantially of a rectangular plate having a raised edge 8 (see FIG. 2) so that weights 9 and 9' set on it are prevented from sliding off during use of the apparatus. FIG. 2 further shows that the two brushes 2 and 3 each project laterally beyond the frame 1. This has the advantage that the brushes 2 and 3 can also engage with their projecting ends under pieces of furniture which stand on the carpet 6 to be cleaned.

Figure 3:
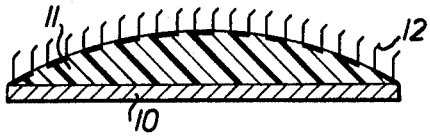
FIG. 3 a section through a single brush in accordance with the invention.

FIG. 3 shows a section through one of the brushes 2 or 3. Thus there is anchored in the brush carrier 10 an elastic bristle bed 11 from which extend individual wire bristles 12 whose under ends are bent into hooks. Each bristle 12 can as a result of this elastic anchoring be elastically deflected around individual objects offering resistance, as for instance in so-called velour fasteners, without damaging the nap material.

The brush 3 projects relative to the brush 2 not so far downwardly as the latter so that its engagement is not as deep as that of the brush 2. As a result of the reduced scale this slight height difference cannot be seen in the drawing.

Figure 4:
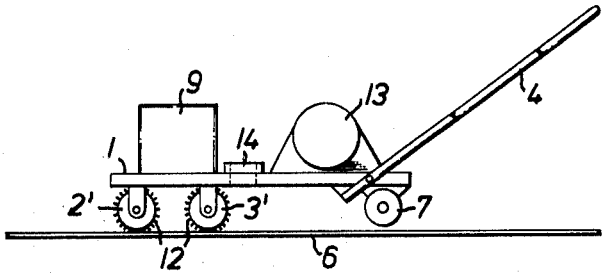
FIG. 4 is a view similar to FIG. 1 illustrating another apparatus according to the present invention.

FIG. 4 shows an arrangement similar to that of FIGS. 1–3, but wherein cylindrical brush rollers 2' and 3' similar in construction to the brushes 2 and 3 are provided on the frame 1 and driven by an electric motor 13 thereon. The drive rollers 7 of this device, which may be differently constructed, are also connected to this motor 13.

In this arrangement there is provided at the backward end of the frame 1 a closable opening 14 connectable to a vacuum cleaner so as to be able to inspire dirt freed by the brushes 2' and 3'.

I claim:

1. An apparatus for treating a carpet having a nap, said apparatus comprising a carrier displaceable over said carpet; means for displacing said carrier over said carpet in a predetermined transport direction; two brushes mounted on said carrier and having an elastic bedding and a multiplicity of individual wire bristles secured in said bedding and extending downwardly therefrom, whereby said bristles are engageable in said nap to loosen up the same, said bristles being elastically deflectable by said nap in said bedding, and said two brushes being spaced apart in said direction, the brush trailing in said direction having bristles which project downwardly further than the bristles of the leading brush, thereby effecting a raising of the nap of said carpet to an increasing extent in subsequent individual steps, by first loosening up said nap by the bristles of said leading brush and by completely raising said nap by the bristles of said trailing brush; and means for supporting said carrier on said carpet during displacement thereover with said bristles engaging through said nap.

2. The apparatus defined in claim 1 wherein said bristles have ends bent over in said direction.

3. The apparatus defined in claim 2 wherein said carrier is constructed and adapted to carry weights for loading said brushes.

4. The apparatus defined in claim 1, wherein said carrier is formed behind said brush relative to said direction with a throughgoing closable hole adapted to be connected to a vacuum cleaner, whereby dust freed by said brush can be aspirated through said opening.

5. An apparatus for treating a carpet having a nap, said apparatus comprising:

a carrier displaceable over said carpet in a predetermined direction;

at least one brush mounted on said carrier and having an elastic bedding and a multiplicity of individual wire bristles secured in and extending downwardly from said beding and having ends bent over in said direction, whereby said bristles are engageable in said nap to loosen up same;

rollers rotatable on said carrier and supporting said carrier on said carpet with said bristles engaged with said nap, whereby said rollers rotate when engaging said carpet and on displacement of said carrier in said direction; and an electric motor on said carrier connected to said rollers to rotate same and displace said apparatus along said carpet in said direction.

6. An apparatus for treating a carpet having a nap, said apparatus comprising:

a carrier displaceable over said carpet;

at least one cylindrical brush mounted on said carrier and having an elastic bedding and a multiplicity of individual wire bristles secured in said bedding, at least some of said bristles extending downwardly from said bedding toward said carpet, said bristles being elastically deformable by said nap in said bedding; and an electric motor on said carrier connected to said brush for rotating same and thereby loosening up nap engaged by said bristles.

7. The apparatus defined in claim 6 wherein said carrier has two such cylindrical brushes spaced apart in a transport direction, the trailing brush having bristles projecting downwardly further than the bristles of the leading brush.

* * * * *